United States Patent [19]

Sandor, Sr.

[11] Patent Number: 4,779,324

[45] Date of Patent: Oct. 25, 1988

[54] METHODS FOR FABRICATING CONCRETE PANELS WITH EMBEDDED GLASS BLOCK

[75] Inventor: Frederick J. Sandor, Sr., Cheshire, Conn.

[73] Assignee: Circle Redmont, Inc., Wallingford, Conn.

[21] Appl. No.: 866,323

[22] Filed: May 22, 1986

[51] Int. Cl.[4] ..... E01C 17/00

[52] U.S. Cl. ..... 29/451; 29/530; 164/34; 249/61; 264/221; 404/24

[58] Field of Search ..... 249/62, 61, 39, 83, 249/31; 164/34, 35; 264/221; 29/10, 400 M, 400 C, 451, 527.1, 530; 404/22, 23, 24

[56] References Cited

U.S. PATENT DOCUMENTS

| | | | |
|---|---|---|---|
| 422,218 | 2/1890 | Jacobs | 404/24 |
| 431,468 | 7/1890 | Jacobs | 404/22 |
| 1,821,003 | 9/1931 | Bruner et al. | 404/22 |
| 1,893,101 | 1/1933 | Old | 404/22 |
| 2,426,796 | 6/1945 | Stadelhofer | 249/19 |
| 3,421,551 | 1/1969 | Currier | 249/61 X |
| 4,629,155 | 12/1986 | Dula | 249/61 |

*Primary Examiner*—P. W. Echols
*Assistant Examiner*—Joseph M. Gorski
*Attorney, Agent, or Firm*—Joseph J. Kaliko

[57] ABSTRACT

Methods are set forth for fabricating a concrete panel with embedded glass block. According to the invention the panel form includes at least one partially anchorable support form, i.e., a support form having an anchorable portion and a removable, nonanchorable portion. After concrete is poured into the panel form and hardened, the nonanchorable portion of the support form is removed. A noncementitious band (or collar), of which the anchored portion of the support form is comprised, remains. The glass block is then inserted within this band. According to the preferred embodiment of the invention a rubber seal may be inserted between the glass and noncementitious surface to both waterproof the panel and cushion the block to improve the completed panel's ability to be handled and transported without damage. Furthermore, the invention teaches utilizing the support form to create at least one support lip. Each lip may be formed as part of the anchored band or as part of the formed concrete panel. The lip(s) provide support upon which to rest the block and improve the panel's load bearing capacity. A given lip may take any number of shapes and can be designed to take advantage of the inherent load bearing capacity of the concrete in which it is set and/or formed to support the anticipated load. Additional glazing and sealing steps may be optionally performed to further cushion the block and hold it firmly in place.

18 Claims, 3 Drawing Sheets

METHODS FOR FABRICATING CONCRETE PANELS WITH EMBEDDED GLASS BLOCK

BACKGROUND OF THE INVENTION

1. Field of the Invention

The invention generally relates to methods for forming concrete panels with embedded glass block and more particularly relates to methods and apparatus for fabricating such panels in a manner which enhances their ability to resist leaks, bear loads and be transported safely.

2. Description of the Related Art

The prior art is replete with methods for fabricating concrete panels. Such panels are commonly used to construct buildings, facades, walkways, driveways, etc.

Also known are concrete panels which incorporate glass block in a variety of shapes. When shaped like a paving stone or used in a driveway or walkway the glass is often referred to as "paver block". Concrete panels with embedded glass block are used in virtually every application where ordinary concrete can be used and is decorative as well as functional. The glass embedded panels in some instances permit the passage of light through an otherwise opaque panel. In many instances the load bearing capacity of the glass embedded panels is important, for example, if a car or truck is to be driven over the panel or if the panel forms a load bearing portion of a structure.

One arrangement for securing glass in concrete is taught in U.S. Pat. No. 422,218, issued to J. Jacobs, entitled "Illuminating Tile", issued Feb. 25, 1890. The Jacobs patent is directed to increasing the amount of light that can be passed via illuminating tiles. According to the illustrative embodiment set forth by Jacobs the tiles form a walkway. To secure the tiles, Jacobs teaches setting an illuminating lens (the glass block) in an enclosing ring, made separate from a metal supporting plate upon which the ring rests. The ring is then locked in concrete which is poured into a form comprised of the metal plate. Jacobs then teaches waterproofing the tile via filling the space between the enclosing ring and the glass lens with brimstone, cement, or other waterproof packing, above a portion of the lens which is flush with the ring. The entire combination of ring, lens and sealant are mounted on the separate metal plate to provide support for the combination.

The metallic form and base required by Jacobs to support the enclosing ring, sealant and lens combination is undesirable for modern day construction because it adds weight to the panels and cost to the fabrication process.

Since the time of Jacobs, monolithic concrete panel structures have been fabricated which eliminate the aforementioned metallic support base. The known monolithic panel fabrication techniques involve forming a concrete panel with voids substantially in the shape of the glass block. The glass block inserted into the voids is then bonded to the concrete and sealed via a cementitious sealant such as grout. This technique is currently in use independent of whether the panel is designed to transmit light via the glass block (lens) and independent of whether the glass embedded panel is to support a load.

Although the enclosing ring and separate metal support base taught by Jacobs are eliminated by the monolithic panel fabrication techniques, unless a substantial cement base sits below the glass block, the overall panel's ability to bear a load is sacrificed. With a transparent panel the problem of building in enough support for an anticipated load is compounded by the limited size of any concrete base upon which the lens can rest and still provide an opening for light.

In addition, the handling and transportation of panels with embedded glass block, particularly of the monolithic type, has proven to be problematic. The cementitious material commonly used to seal and waterproof such panels is typically inserted directly between the glass block and cement panel itself in the location where the Jacobs type retaining ring existed. Such sealing techniques have the effect of putting a rigid mass between the concrete and glass which very often cracks during handling and transportation. Still further, a cementitious sealant is pourous and with one face against concrete and the other against glass, the waterproofing characteristic of the seal is deminished.

Prior art techniques are also known which were devised to eliminate not only the rings and steel support plates, but also the cementitious seal. U.S. Pat. No. 2,426,796, issued Sept. 2, 1947 to F. F. Stadelhofer, entitled "Concrete Wall Form", teaches methods and apparatus to cast glass block directly into concrete to eliminate after-fitting, glazing and grouting. With virtually no cushioning of the glass block in the concrete, these panels are also susceptable to being damaged while being transported and the desired waterproof seal between the glass and concrete is nonexistent.

Based on the known techniques for fabricating concrete panels with embedded glass block, it is desirable to have panel fabricating methods which yield a glass embedded panel that does not require a metal support base, holds up well when being handled or transported, is waterproof and is capable of bearing desired, preselected loads. Such panel fabricating methods are desirable for forming both light transmitting and opaque concrete panels with embedded glass block.

SUMMARY OF THE INVENTION

To solve the problems inherent in the prior art techniques for fabricating concrete panels with embedded glass block, the invention calls for constructing a panel form that includes at least one partially anchorable support form , i.e., a support form having an anchorable portion and a removable, nonanchorable portion . After concrete is poured into the panel form and hardened, the nonanchorable portion of the support form is removed. A noncementitious band (or collar), of which the anchored portion of the support form is comprised, remains. The glass block is then inserted within this band.

According to the preferred embodiment of the invention a resilient seal, like a rubber gasket, may be inserted between the glass and noncementitious surface to both waterproof the panel and cushion the block to improve the completed panel's ability to be handled and transported without damage. Furthermore, the invention teaches utilizing the support form to create at least one support lip. Each lip may be formed as part of the anchored band or as part of the formed concrete panel. The lip(s) provide a support upon which to rest the block and improve the panel's load bearing capacity. A given lip may take any number of shapes and can be designed to take advantage of the inherent load bearing capacity of the concrete in which it is set and/or formed to support the anticipated load. Additional glazing and sealing steps may be optionally performed to further cushion the block and hold it firmly in place.

Hereinafter, the terms "support form" and "block support form" are used interchangeably to mean forms which, after concrete is poured about the form and hardened, yield the aforementioned support lip(s). It will be seen that using block support forms, in accordance with the methods taught hereinafter, to fabricate concrete panels, allows glass block, tile and other materials to be directly inserted into, and inherently supported by, the formed panel/support form combination.

It is an object of the invention to provide methods for fabricating concrete panels with embedded glass block that may be used to support a preselected load using the inherent properties of the hardened concrete panel itself to provide support means to bear the load.

It is a further object of the invention to provide methods for sealing and waterproofing such panels and at the same time cushion the panels and component parts thereof while being handled and transported.

It is still a further object of the invention to provide methods for fabricating relatively lightweight, moisture and breakage resistant concrete panels, with embedded glass block, which are capable of bearing loads and optionally transmitting light.

It is further yet an object of the invention to provide concrete panels as have been outlined hereinabove that permit easy replacement of glass block once the panel has been formed.

Other objects and features of the present invention will become apparent to those skilled in the art upon consideration of the following detailed description and the accompanying Drawing, in which like reference designations represent like features throughout the figures.

BRIEF DESCRIPTION OF THE DRAWINGS

FIG. 1*a* is a plan view of one such band, FIG. 1*b* is a sectional view of the band shown in FIG. 1*a* and FIG. 1*c* depicts another version of the band.

FIG. 6*a* depicts a suitable resilient seal and FIG. 6*b* depicts how the seal depicted in FIG. 6*a* may be used in combination with glazing and semisolid materials to position, cushion and secure the block.

DETAILED DESCRIPTION

Figure 1A:
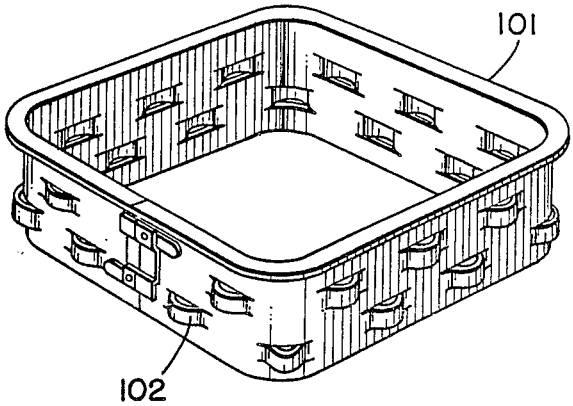
FIGS. 1*a*–1*c* depict various views of two types of noncementitious bands that may be used as the anchorable portion of the support form according to the preferred embodiment of the invention.
Figure 1B:
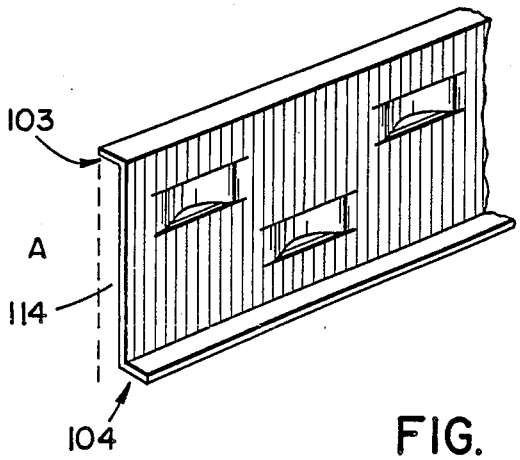

FIGS. 1*a* and 1*b* depict two views of the anchorable portion of a support form suitable for use with the instant invention.

Unit 101 is a noncementitious band shown in a square configuration to accomodate a square glass block having dimensions that are slightly less then the band. The band is made slightly larger then the block to accommodate the insertion of a sealant and possibly filler material between the inserted block and the band.

Unit 101 is, according to the preferred embodiment of the invention, fabricated from stainless steel. The preferred band will have a smooth inner surface and "punchouts", extending outward from the band, to provide anchor hooks to secure the band in the concrete panel poured. These hook punchouts are typified by punchout 102. Obviously this type of anchor support is for the sake of illustration only. Any variation that locks the band in the concrete is contemplated by the invention described herein. The band's shape may obviously be varied as well.

FIG. 1*b* shows a sectional view of band 101, and may be seen to include support lips 103 and 104. With the portion of FIG. 1*b* labeled "A" constituting the outside of band 101, concrete poured into the panel, upon hardening, will form a support beam under lip 103. The "beam" that will be formed is shown in dotted lines, running around the outside perimeter of band 101, as beam 114.

FIG. 1*b* also shows support lip 104 upon which a glass block may be rested. The height of the band, together with the degree to which lips 103 and 104 extend from the vertical portion of the band, can be adjusted to provide a predetermined amount of support for the glass block and will obviously be a factor in determining the overall load bearing capacity of the formed panel.

Figure 1C:
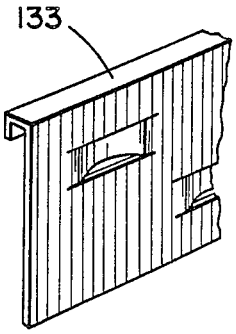

FIG. 1*c* depicts another type of anchorable band used as part of a support form contemplated by the invention. The only lip extending from the band depicted in FIG. 1*c* is lip 133. Lip 133 corresponds to lip 103 in FIG. 1*a*, is shaped differently then lip 103, and is an example of a band that may be used in applications where the block itself has independent support. For example, the block can be rested on one or more support lips formed in the concrete panel itself after concrete is poured, hardened, and the unanchored portion of the support form is removed.

Thus it may be seen from FIGS. 1*a*–1*c* that the support lips that come in contact with the glass block may be a part of the anchorable portion of the band itself and/or the hardened concrete upon which a block rests once the nonanchorable portion of a support is removed. Also, it may be observed that a predetermined panel load bearing capacity can be achieved by selecting the amount of concrete to be positioned underneath a support lip formed by the anchorable portion of the support form and/or by selecting the amount of concrete to be positioned underneath the block itself, once the nonanchorable portion of a support form is removed.

Not depicted, but contemplated by the invention as well, are anchorable bands without support lips. In cases where the glass block will rest on concrete deemed to give adequate support, the support lips on the anchorable band may be dispensed with altogether.

Figure 2A:
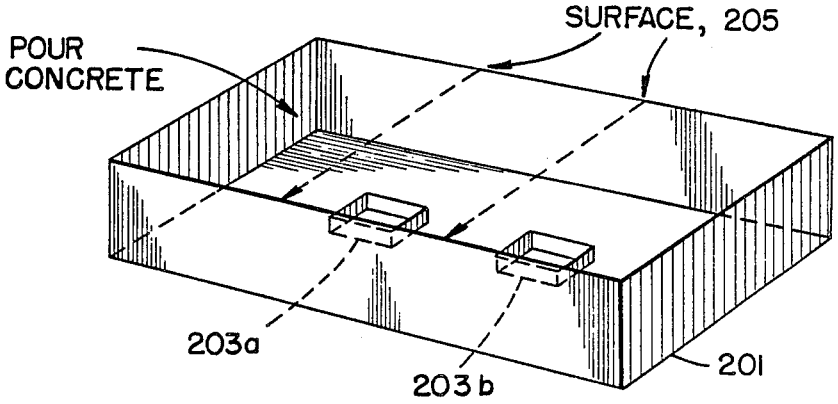
FIGS. 2*a* and 2*b* depict concrete panel forms which include support forms, of the type contemplated by the invention, to create cavities within which to embed glass block to form an opaque panel.

FIG. 2*a* depicts a panel form 201, which may be used to form an opaque concrete panel with embedded glass block. The form, in this example and the preferred embodiment, comprises a removable wooden perimeter which forms a trough the size and shape of the panel. Into the trough, two Styrofoam support forms, 203*a* and 203*b* respectively, are shown positioned as desired. Forms 203*a* and 203*b* are not thru panel forms since an opaque panel is being fabricated. It will be seen hereinafter, referring to FIGS. 4*a*–4*f*, that support forms 203*a* and 203*b* further comprise an anchorable portion in addition to the Styrofoam nonanchored portion referred to hereinabove.

Although Styrofoam is used in accordance with the preferred embodiment of the invention as part of the support forms, this is not intended to be a limiting factor. Any material which is removable after the concrete is poured would be suitable.

Figure 2B:
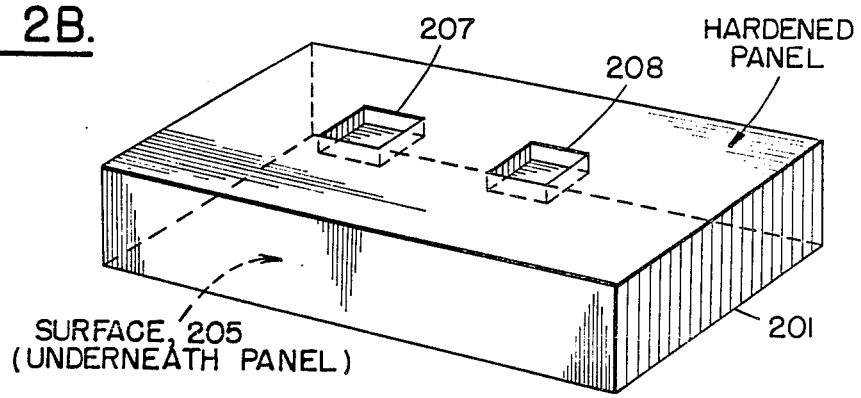

Clearly, once concrete is poured into a panel form, such as shown in FIG. 2*a*, and hardened, the formed panel can be flipped over to rest on surface 205, created at the top of the trough as originally positioned (see FIGS. 2*a* and 2*b*). The support forms, to the extent they are removable, can be taken out to expose voids 207 and 208 into which glass block may then be inserted.

The completed opaque panel may obviously be designed to include a different number of glass blocks.

Figure 3A:
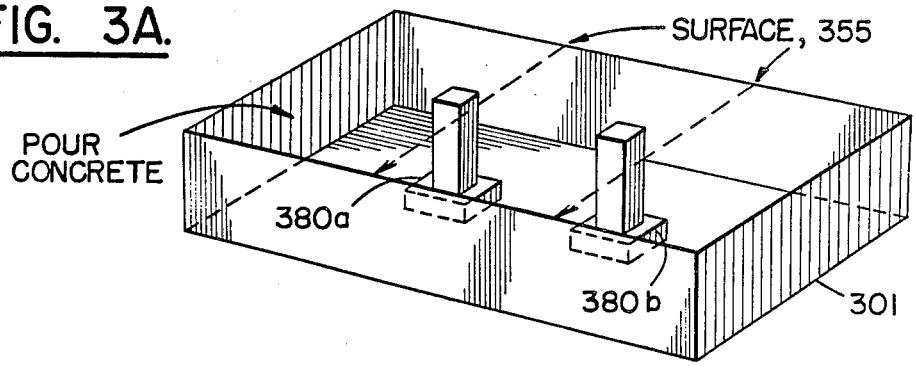
FIGS. 3*a* and 3*b* depict concrete panel forms which include support forms, of the type contemplated by the invention, to create cavities within which to embed glass block to form a panel that transmits light.
Figure 3B:
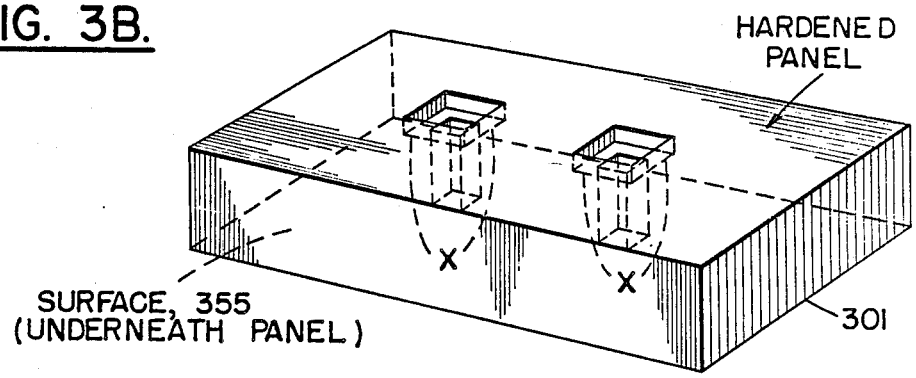

FIG. 3*a* shows thru trough support forms 380*a* and 380*b* which, when the hardened concrete panel is flipped onto surface 355, form cavities within which to place glass block so that the glass rests on the concrete support lip shown as "X", surrounding the block. This may be seen with reference to FIG. 3*b* depicting hardened panel 301, flipped onto surface 355. Variations of the support form to create support lips not completely surrounding a block are also contemplated by the invention.

It should be observed that light may be transmitted through the completed panel via the glass block and the void created by removing the nonanchorable portion of the thru panel support form.

FIGS. 4*a*–4*f* depict cross sections of several different types of support forms contemplated by the invention. Each of the support forms depicted in FIGS. 4*a*–4*f* are comprised of both the anchorable and nonanchorable portions referred to hereinabove.

Figure 4A:
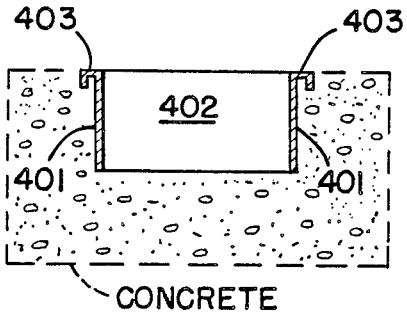
FIGS. 4*a*–4*f* depict cross sections of different types of support forms contemplated by the invention.

FIG. 4*a* is depicted as having an anchorable portion, band 401, which surrounds Styrofoam block 402. Band 401 is meant to be similar to the band depicted in FIG. 1*c*, with support lip 403 corresponding to lip 133 of FIG. 1*c*. Again, with reference to FIG. 4*a*, it may be seen that support lip 403 could be eliminated since the glass block is shown resting on a concrete base; however, lip 403 may be included to give a metallic finish to the panel surface if the band it is part of is anchored so lip 403 is flush with the surface.

Styrofoam block 402 is the support form bulk that resists the fluid pressure of the poured concrete to form the cavity in which the glass block to be embedded in the panel will be set.

Band 401 may be attached to the Styrofoam in any one of a number of ways. A channel or groove in, or outward extending nubs from the Styrofoam form, adhesives, etc., are examples of ways to support the band until it is anchored in concrete.

Once the band is locked in the concrete via the anchor means, not shown in FIG. 4*a* but described hereinbefore, and the concrete has hardened, the Styrofoam block may be removed. The same method applies using any of the support forms described herein.

FIG. 4*a* shows band 401 running the full length (vertical) of the Styrofoam block. This is not required by the invention. The amount of inner band surface presented toward the glass block face may be varied as desired to accommodate the waterproof, resilient sealant to be inserted therebetween as will be explained hereinafter.

Figure 4B:
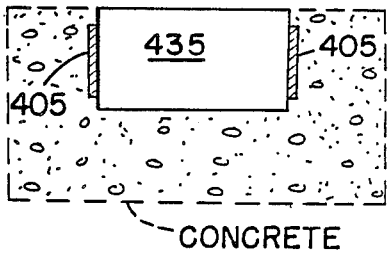

FIG. 4*b* depicts an anchor band, 405, without support lips, running partway up the Styrofoam block. Once again, as with FIG. 4*a*, the Styrofoam block when removed will form the concrete support lip (lip 435) upon which to rest the inserted block.

Figure 4C:
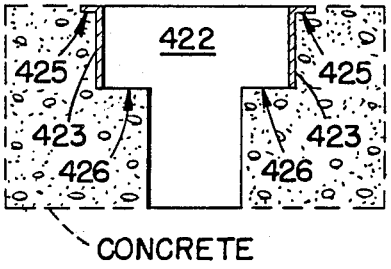
Figure 4D:
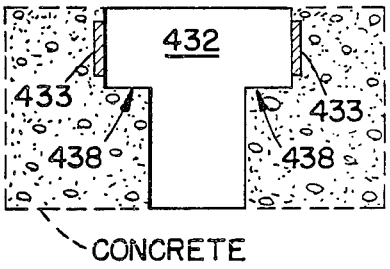

FIGS. 4*c* and 4*d* illustrate examples of support forms designed to be utilized in fabricating panels which transmit light. These forms are also illustrated in FIGS. 3*a* and 3*b*.

The support forms shown in FIGS. 4*c* and 4*d* are thru panel. According to the preferred embodiment of the invention the thru panel support forms are comprised of Styrofoam blocks which are removable, and anchorable bands of the type described hereinbefore. FIG. 4*c* depicts the support form as the combination of Styrofoam block 422 and anchorable band 423; FIG. 4*d* depicts the support form as the combination of Styrofoam block 432 and anchorable band 433.

In FIG. 4*c* two support lips are illustrated. One is formed by lip 425 of anchorable band 423; the other is formed by the concrete lip, 426, that will be formed once the cement is poured, hardened and the Styrofoam is removed.

Since the glass will rest on lip 426, lip 425 is not actually supporting the glass. As indicated hereinbefore, this lip may be used to provide a metallic finish on the surface of the panel.

FIG. 4*d* illustrates using an anchorable band without support lips and once again it may be seen that a concrete lip, 438, will support the block.

The concrete lip shown in FIGS. 4*c* and 4*d* may obviously be varied in size and shape to adjust the support capacity of the panel, by adjusting the size and shape of Styrofoam blocks 422 and 432, respectively.

Figure 4E:
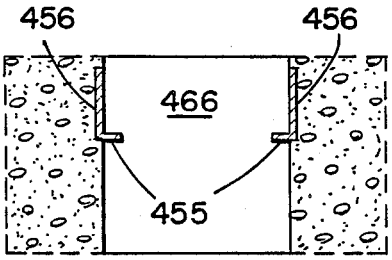
Figure 4F:
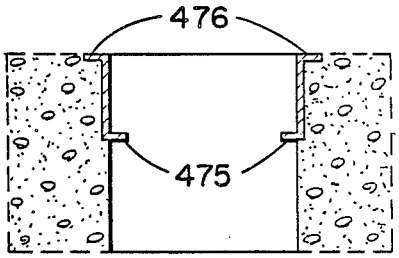

FIGS. 4*e* and 4*f* illustrate situations where the anchorable band is called upon to actually support the block.

FIG. 4*e* depicts the band with support lip 455. Here the Styrofoam block, shown as 466, is meant to be thru panel. The glass block support lip 455 is shown cut into the Styrofoam block. The remainder of the anchorable band, the portion depicted as 456, is affixed in or to the Styrofoam in any of the ways indicated hereinbefore.

The anchored band and the rigidity of the support lip provide the load bearing capacity for the inserted block. This capacity may be increased by using an anchorable band of the type shown in FIG. 1*b* and illustrated in FIG. 4*f* as part of a support form. The choice of material from which to fabricate the band can also be used to add strength. In FIG. 4*f*, once the band is set in concrete, support is provided for the block by lips 475 and 476, both part of the anchorable band. The inherent properties of the concrete form a "beam" under lip 476 to increase the load bearing capacity of the completed panel as compared with the panel constructed using the FIG. 4*e* type support form. This "beam" effect was illustrated hereinbefore with reference to FIG. 1*b*. In addition, support lip 476 can be positioned to increase or decrease the height of the concrete "beam" upon which it rests. It should also be noted that the support region may be extended or contracted horizontally as well by adjusting the horizontal length of lip 476.

The forms depicted in FIGS. 4*a*–4*f* are for the sake of illustration only. The teaching of the invention is that various combinations of anchorable and nonanchorable portions of the support form taught herein may be used to create various types of support lips to bear anticipated loads that may be placed on a completed panel.

Figure 5:
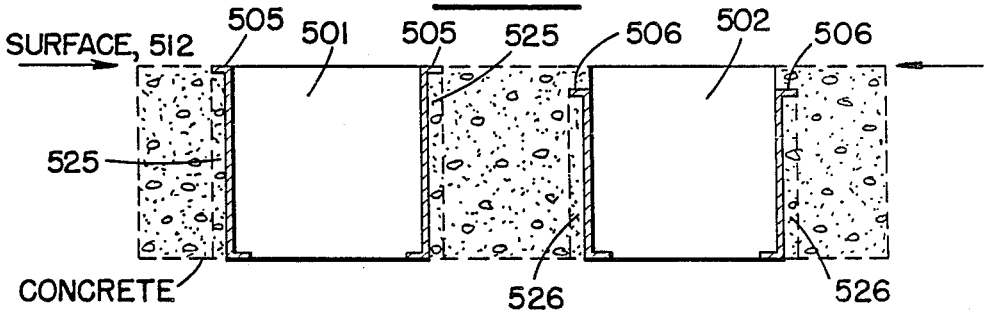
FIG. 5 depicts a panel form and suitable support forms which, according to the invention, accommodate supporting glass block which is approximately the same thickness as the panel in which the glass is to be inserted.

FIG. 5 depicts a cutaway view of a panel and support forms, which accommodate supporting glass block of approximately the same thickness as the panel into which the glass is to be inserted. The depicted panel form contains two support forms. In both cases the glass block is to be approximately the same thickness as the panel. The lefthand support form, 501, is designed to have a metallic surface finish on surface 512; the righthand support form, 502, is designed to have a concrete finish. The support forms used are of the type depicted in FIG. 4*f*.

The "beams" that will be formed underneath support lips 505 and 506 respectively, are illustrated by dotted lines and labeled as beam 525 and 526 respectively.

Figure 6A:
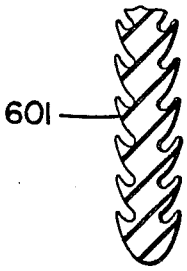
FIGS. 6*a* and 6*b* depict an example of how glass block inserted into a panel form may be cushioned and sealed in accordance with the teachings of the invention.
Figure 6B:
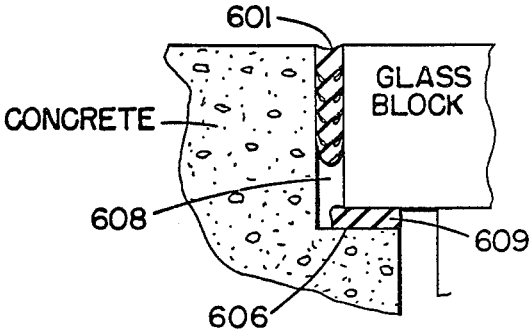

Finally, FIG. 6 illustrates how glass block inserted into a panel form may be cushioned and sealed in accordance with the teachings of the invention. FIG. 6*a* depicts a suitable resilient seal and FIG. 6*b* depicts how the seal depicted in FIG. 6*a* may be used in combination with glazing and semisolid materials to position, cushion and secure the block.

Seal 601 shown in FIG. 6*a*, according to the preferred embodiment of the invention, is a rubber gasket. Any resilient sealant will do. The purpose of the resilient sealant is to waterproof the panel where the glass and noncementitious band faces oppose one another. At the same time, the resilient seal is to cushion the glass block so as to absorb the shock and stresses asserted on the completed panel when being handled or transported.

FIG. 6*b* depicts an example of how further cushioning of a block may be achieved if desired. Additional cushioning material could be placed on concrete support lip 606 upon which the block in FIG. 6*b* is shown to be resting. The cushion would again preferrably be provided by a resilient type of material such as rubber. Obviously, a cushion could also be provided for block lying on a support lip formed by the anchorable band itself as well as block resting on concrete.

The block may also rest on a glazing compound to further waterproof the joint. The compound is shown as 609 in FIG. 6*b*.

Still further, semisolid material may be injected into any cavity, such as cavity 608 shown in FIG. 6*b*, to further stabilize the inserted block prior to inserting seal 601.

An important feature of panels constructed as indicated hereinbefore is the ease with which glass block can be replaced. Should the block become damaged or should the user merely wish to replace it with a different colored block, etc., all that need be done is remove the resilient seal and lift the old block out of its cavity. The new block can then be inserted, sealed, etc. in its place.

What has been described are methods for fabricating concrete panels with embedded glass block that achieve the objectives set forth hereinbefore.

The foregoing description of a preferred embodiment of the novel methods for achieving the objects of the invention has been presented for purposes of illustration and description. It is not intended to be exhaustive or to limit the invention to the precise form disclosed, and obviously many modifications and variations are possible in light of the above teaching.

For example, the support lips on the anchorable bands could come in a variety of shapes, such as flat top, inverted "U" shape tops, etc., to vary the degree of support provided. The resilient seals can come in any number of shapes or sizes, and support forms embodying the principles taught herein can vary in size, shape and composition of materials without departing from the scope or spirit of the invention.

The embodiment and examples set forth herein were presented in order to best explain the principles of the instant invention and its practical application to thereby enable others skilled in the art to best utilize the instant invention in various embodiments and with various modifications as are suited to the particular use contemplated.

In particular, alternative embodiments of the invention are contemplated in which concrete panels are fabricated with embedded acrylics and/or composite materials, such as fiberglass, instead of embedded glass block. The invention disclosed and claimed is meant to cover any material and/or substance that may be used in place of glass block per se so long as it is embedded in a concrete panel using the fabrication techniques taught herein.

It is intended that the scope of the instant invention be defined by the claims appended hereto.

What is claimed is:

1. A method for fabricating a concrete panel with embedded glass block, comprising the steps of:

(a) constructing a panel form that includes at least one block support form having an anchorable portion and a removable non-anchorable portion for each glass block to be embedded in said panel;

(b) positioning each such support form in a preselected location within said panel form;

(c) pouring concrete into said panel form thereby anchoring the anchorable portion of each support form in its preselected location;

(d) curing said poured concrete;

(e) removing the removable non-anchorable portion of each block support form once said poured concrete has cured, thereby forming at least one void for the insertion of said glass block and a sealant;

(f) inserting glass block into each void that is created in said panel by removing the removable non-anchorable portion of each block support form; and (g) inserting a resilient sealant between said inserted glass block and the concrete anchored portion of said support form, thereby providing a cushioned waterproof seal between said glass block and said concrete anchored portion of said support form so that no portion of the glass block directly contacts the anchored portion of said block support form.

2. A method as set forth in claim 1 further comprising the step of shaping each block support form to result in at least one support lip being formed after said step of pouring concrete into said panel form is performed.

3. A method as set forth in claim 2 further comprising the step of resting said inserted glass block on a support lip formed by said steps of shaping and pouring to enhance the load bearing capacity of the panel.

4. A method as set forth in claim 3 further comprising the step of cushioning the block to be placed on a given one of said support lips prior to resting said block thereon.

5. A method as set forth in claim 4 further comprising the step of supporting said block on a given one of said support lips formed as part of the anchorable portion of a support form.

6. A method as set forth in claim 4 further comprising the step of supporting said block on a given one of said support lips formed as part of the concrete panel formed by a support form.

7. A method as set forth in claim 4 wherein said step of cushioning is performed by glazing a given one of said support lips prior to resting said block thereon.

8. A method as set forth in claim 4 further comprising the step of inserting semisolid material in any void that may exist between said block, each of said support lips and said resilient sealant, to firmly hold said glass block in place.

9. A method as set forth in claim 1 further comprising the step of forming the anchorable portion of each support form as a band of noncementitious material within which said glass block and said sealant may be inserted, wherein said band further includes anchor means for anchoring the band into concrete.

10. A method as set forth in claim 9 wherein said band is formed of stainless steel.

11. A method as set forth in claim 10 wherein said resilient seal comprises a rubber gasket.

12. A method for fabricating a concrete panel with embedded glass block, comprising the steps of:

(a) constructing a panel form that includes at least one block support form having an anchorable portion and a removable non-anchorable portion for each glass block to be embedded in said concrete panel;

(b) positioning each such support form in a preselected location within said panel form;

(c) shaping each block support form to result in at least one support lip being formed after pouring concrete into said panel form;

(d) forming the anchorable portion of each support form as a band of noncementitious material within which said glass block and a sealant may be inserted, wherein said band further includes anchor means for anchoring the band into concrete;

(e) pouring concrete into said panel form thereby anchoring the anchorable portion of each support form in its preselected location ;

(f) curing said poured concrete;

(g) removing the removable non-anchorable portion of each block support form once said poured concrete has cured, thereby forming at least one void for the insertion of said glass block and said sealant;

(h) cushioning the block to be placed on a given one of said support lips, prior to resting the block thereon;

(i) inserting glass block into each void that is created in said panel by removing the removable non-anchorable portion of each block support form;

(j) resting said inserted glass block on a support lip formed by said steps of shaping and pouring to enhance the load bearing capacity of the panel; and (k) inserting a resilient sealant between said inserted glass block and the concrete anchored portion of said support form, thereby providing a cushioned waterproof seal between said glass block and said concrete anchored portion of said support form so that no portion of the glass block directly contacts the anchored portion of said block support form.

13. A method as set forth in claim 12 further comprising the step of inserting semisolid material in any void that may exist between said block, each of said support lips and said resilient sealant, to firmly hold said glass block in place.

14. A method as set forth in claim 12 wherein said band is formed of stainless steel.

15. A method as set forth in claim 12 wherein said resilient seal comprises a rubber gasket.

16. A method for fabricating a concrete panel with embedded acrylic block, comprising the steps of:

(a) constructing a panel form that includes at least one block support form having an anchorable portion and a removable non-anchorable portion for each acrylic block to be embedded in said panel;

(b) positioning each such support form in a preselected location within said panel form;

(c) pouring concrete into said panel form thereby anchoring the anchorable portion of each support form in its preselected location;

(d) curing said poured concrete;

(e) removing the removable non-anchorable portion of each block support form once said poured concrete has cured, thereby forming at least one void for the insertion of said acrylic block and a sealant;

(f) inserting acrylic block into each void that is created in said panel by removing the removable non-anchorable portion of each block support form; and (g) inserting a resilient sealant between said inserted acrylic block and the concrete anchored portion of said support form, thereby providing a cushioned waterproof seal between said acrylic block and said concrete anchored portion of said support form so that no portion of the acrylic block directly contacts the anchored portion of said block support form.

17. A method for fabricating a concrete panel with embedded composite block, comprising the steps of:

(a) constructing a panel form that includes at least one block support form having an anchorable portion and a removable non-anchorable portion for each composite block to be embedded in said concrete panel;

(b) positioning each such support form in a preselected location within said panel form;

(c) pouring concrete into said panel form thereby anchoring the anchorable portion of each support form in its preselected location ;

(d) curing said poured concrete;

(e) removing the removable non-anchorable portion of each block support form once said poured concrete has cured, thereby forming at least one void for the insertion of said composite block and a sealant;

(f) inserting composite block into each void that is created in said panel by removing the removable non-anchorable portion of each block support form; and (g) inserting a resilient sealant between said inserted composite block and the concrete anchored portion of said support form, thereby providing a cushioned waterproof seal between said composite block and said concrete anchored portion of said support form so that no portion of the composite block directly contacts the anchored portion of said block support form.

18. A method for fabricating a concrete panel with embedded translucent block comprising the steps of:

(a) constructing a panel form that includes at least one block support form having an anchorable portion and a removable non-anchorable portion for each block to be embedded in said panel;

(b) positioning each such support form in a preselected location within said panel form;

(c) pouring concrete into said panel form thereby anchoring the anchorable portion of each support form in its preselected location;

(d) curing said poured concrete;

(e) removing the removable non-anchorable portion of each block support form once said poured concrete has cured, thereby forming at least one void for the insertion of said block and a sealant;

(f) inserting said block and sealant into each void created by removing the removable non-anchorable portion of each block support form, wherein said sealant is resilient, is positioned to provide a cushioned waterproof seal between said block and said concrete anchored portion and insures that no portion of the block directly contacts said anchored portion

* * * * *